US008888472B2

(12) United States Patent
Kim

(10) Patent No.: US 8,888,472 B2
(45) Date of Patent: Nov. 18, 2014

(54) WATERPROOF FLUID PUMP WITH MAGNET AND SUPPORT SHAFT ARRANGEMENT

(75) Inventor: Byoung Soo Kim, Anyang-si (KR)

(73) Assignee: Amotech Co., Ltd. (KR)

( * ) Notice: Subject to any disclaimer, the term of this patent is extended or adjusted under 35 U.S.C. 154(b) by 122 days.

(21) Appl. No.: 13/698,326

(22) PCT Filed: May 16, 2011

(86) PCT No.: PCT/KR2011/003575

§ 371 (c)(1),
(2), (4) Date: Nov. 16, 2012

(87) PCT Pub. No.: WO2011/145843

PCT Pub. Date: Nov. 24, 2011

(65) Prior Publication Data

US 2013/0058813 A1 Mar. 7, 2013

(30) Foreign Application Priority Data

May 19, 2010 (KR) ..... 10-2010-0046713

(51) Int. Cl.

| | |
|---|---|
| ***F04D 29/043*** | (2006.01) |
| ***F04D 29/046*** | (2006.01) |
| ***F04D 29/40*** | (2006.01) |
| ***F04D 13/06*** | (2006.01) |
| ***F04D 13/02*** | (2006.01) |

(52) U.S. Cl.

CPC ..... *F04D 13/0633* (2013.01); *F04D 13/064* (2013.01); *F04D 13/027* (2013.01)

USPC ..... 417/420; 417/423.7; 417/423.12; 417/423.14

(58) Field of Classification Search

USPC ..... 417/420, 423.7, 423.12, 423.14, 424.1, 417/424.2

See application file for complete search history.

(56) References Cited

U.S. PATENT DOCUMENTS 3,373,927 A * 3/1968 Miller ..... 417/405
4,277,115 A 7/1981 Stuwe et al.

(Continued)

FOREIGN PATENT DOCUMENTS

| | | |
|---|---|---|
| JP | 06074184 | 3/1994 |
| JP | 2002089491 | 3/2002 |
| JP | 2006274915 | 10/2006 |
| JP | 2007002781 | 1/2007 |

OTHER PUBLICATIONS

International Search Report—PCT/KR2011/003575 dated Jan. 17, 2012.

*Primary Examiner* — Nathan Zollinger
(74) *Attorney, Agent, or Firm* — Cantor Colburn LLP

(57) ABSTRACT

Provided is a waterproof fluid pump including: a motor that is accommodated in a first case and comprises a stator and a rotor, to thus generate a rotating torque; an impeller that is accommodated in a pump housing that is mounted in the first case and that receives the rotating torque of the motor to thus pump fluid; a support shaft to which the rotor and the impeller are rotatably supported and that is fixed to the first case; a first magnet that is fixed to the rotor and is rotated with the rotor; and a second magnet that is fixed to the impeller and is disposed facing the first magnet and that has opposite polarity to that of the first magnet. Thus, fluid may be fundamentally prevented from being introduced into the inside of the motor.

11 Claims, 2 Drawing Sheets

(56) References Cited

U.S. PATENT DOCUMENTS 4,861,240 A * 8/1989 Marioni et al. ..... 417/423.3
4,990,068 A * 2/1991 Zhong et al. ..... 417/423.8
5,316,440 A * 5/1994 Kijima et al. ..... 415/206
6,707,206 B2 * 3/2004 Chang ..... 310/156.08
2004/0062664 A1 * 4/2004 Weigold et al. ..... 417/357

* cited by examiner

WATERPROOF FLUID PUMP WITH MAGNET AND SUPPORT SHAFT ARRANGEMENT

TECHNICAL FIELD

The present invention relates to a waterproof fluid pump that can fundamentally prevent fluid such as water from being introduced in the inside of a motor.

BACKGROUND ART

In general, a water pump motor is used to drive a water pump that is installed in a drain water tank of a washing machine or is used as a driving source of a water pump that is used for circulation of a coolant that cools an engine. A water pump equipped with the water pump motor works under an environment that the inside of the water pump always directly contacts water.

Thus, a motor pump having a mechanical seal structure or a canned motor pump having a canned cover structure for sealing a stator is used for the purpose of protecting a motor from water when the water of the inside of a water pump is drained to the outside of the water pump or in order to prevent failure of bearings or shortened life of belts due to leakage of a coolant.

U.S. Pat. No. 4,277,115 proposed the canned motor pump, in which a canned cover seals only a stator and thus a rotor soaks in water. Accordingly, durability of a bearing to support a rotational shaft is adversely affected. In addition, an optimal magnetic gap cannot be maintained because of a canned cover that is placed between the rotor and the stator, to thereby cause a low efficiency.

In addition, since the rotor soaks in water in the canned motor pump, rotation of the rotor is affected to thus decrease a motor efficiency.

Moreover, since a conventional motor pump has a structure that the axis of rotation of the impeller is integrally formed with the axis of rotation of the motor, a motor assembly and a pump assembly may not be independently assembled and tested, to thus cause a low assembly productivity problem.

In addition, when the canned cover for use in the canned motor pump is molded by using a PPS (PolyPhenylene Sulfide) material and then assembled with a stator, there is a problem that the canned cover is not easily combined with a stator core.

Furthermore, according to the conventional art, the outside of the stator employs a double sealing structure. Here, the outside of the stator is insert-molded, by using BMC (Bulk Mould Compound) and is simultaneously sealed by a canned cover using a PPS sealing material, to thus cause a manufacturing cost to increase.

DISCLOSURE

Technical Problem

To solve the above problems or defects, it is an object of the present invention to provide a waterproof fluid pump that can improve waterproof performance of a motor in which the motor is separated from an impeller and a torque of the motor is transferred to the impeller by using a magnetic force.

It is another object of the present invention to provide a waterproof fluid pump that does need a separate waterproof treatment for achieving a waterproof performance of a motor, and that can improve a motor efficiency by setting an optimal magnetic gap between a rotor and a stator in the motor.

It is still another object of the present invention to provide a waterproof fluid pump that can seal a motor without an additional sealing device, to thus reduce a manufacturing cost.

Technical Solution

To accomplish the above and other objects of the present invention, according to an aspect of the present invention, there is provided a waterproof fluid pump comprising:

a motor that is accommodated in a first case and comprises a stator and a rotor, to thus generate a rotating torque;

an impeller that is accommodated in a pump housing that is mounted in the first case and that receives the rotating torque of the motor to thus pump fluid;

a support shaft to which the rotor and the impeller are rotatably supported and that is fixed to the first case;

a first magnet that is fixed to the rotor and is rotated with the rotor; and a second magnet that is fixed to the impeller and is disposed facing the first magnet and that has opposite polarity to that of the first magnet.

Preferably but not necessarily, the motor is an inner rotor type.

Preferably but not necessarily, a second case that accommodates a driver is mounted on an opened bottom portion of the first case and a third case is sealably mounted on an opened bottom portion of the second case.

Preferably but not necessarily, a throughhole through which the support shaft passes is formed on a top plate of the second case, in which the support shaft is fixed to the second case in an insert-molding method.

Preferably but not necessarily, a pressing unit to which the lower end of the support shaft is pressingly fixed is formed in the second case.

Preferably but not necessarily, the rotor comprises:

a back yoke that forms a magnetic circuit and that is rotatably supported to the support shaft;

a plurality of magnets that are combined on the outer circumference of the back yoke; and a rotor support that extends from the side ends of the back yoke and the magnets.

Preferably but not necessarily, a bearing is disposed between the inner surface of the back yoke and the outer surface of the support shaft in which the bearing is an oil-filled ball bearing.

Preferably but not necessarily, the impeller is rotatably supported on the upper end of the support shaft and an oilless bearing is disposed between the impeller and the support shaft.

Preferably but not necessarily, the first magnet is fixed on the upper end of the rotor and is formed in a ring shape.

Preferably but not necessarily, the first magnet is disposed on the inner surface of the magnets of the rotor and is disposed to have the same polarities as those of the magnets of the rotor.

Preferably but not necessarily, the first magnet is formed in the rotor support in an insert-molding method together with the magnets of the rotor.

Preferably but not necessarily, the second magnet is formed in a ring shape so as to be mounted in a circumferential direction on the bottom surface of the impeller and a back yoke forming a magnetic circuit is provided between the impeller and the second magnet.

Advantageous Effects

As described above, a waterproof fluid pump according to the present invention includes a motor that generates a rotating torque if electric power is applied to the motor, a pump unit that is isolated from the motor and that pumps fluid, and a power transmission unit that is placed between the motor and the pump unit to generate a magnetic force, to thereby fundamentally block water from being introduced into the motor.

In addition, in the case of the waterproof fluid pump according to the present invention, the pump unit having an impeller is mutually isolated from the motor having a rotor and a stator. Accordingly, the waterproof fluid pump according to the present invention does not need a separate waterproof device. In addition, a magnetic gap between the rotor and the stator in the motor is set in an optimal state, to thus enhance efficiency of the motor.

In addition, the waterproof fluid pump according to the present invention can fundamentally block water from being introduced into the inside of the motor, to thereby support a rotational shaft of the motor with an oil-filled ball bearing, and to thus improve durability as well as achieve cost savings.

BEST MODE

Hereinafter, a waterproof fluid pump according to a preferred embodiment of the present invention will be described in detail with reference to the accompanying FIGS. 1 and 2.

Figure 1:
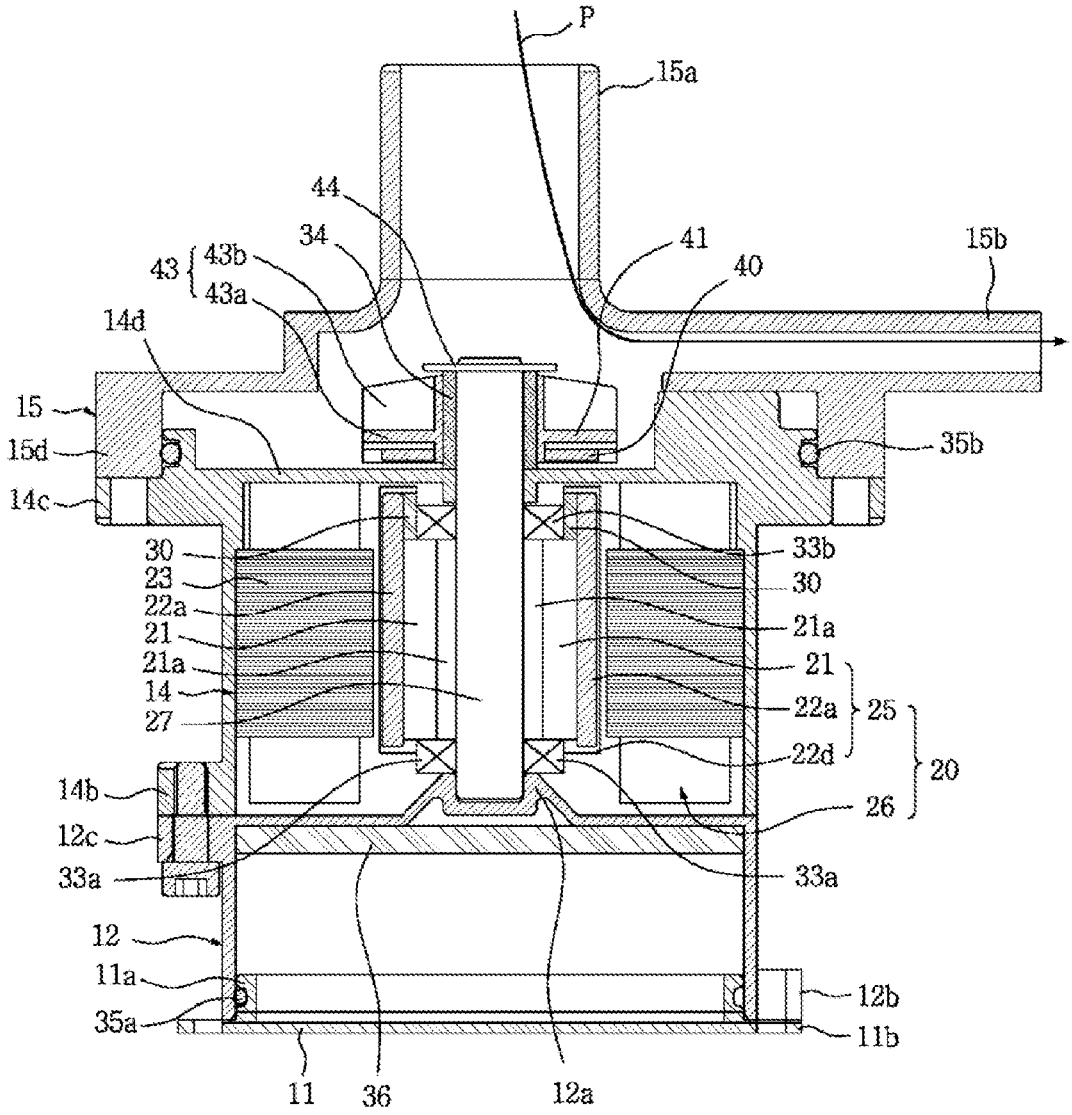
FIG. 1 is a cross-sectional view illustrating a waterproof fluid pump according to an embodiment, of the present invention.
Figure 2:
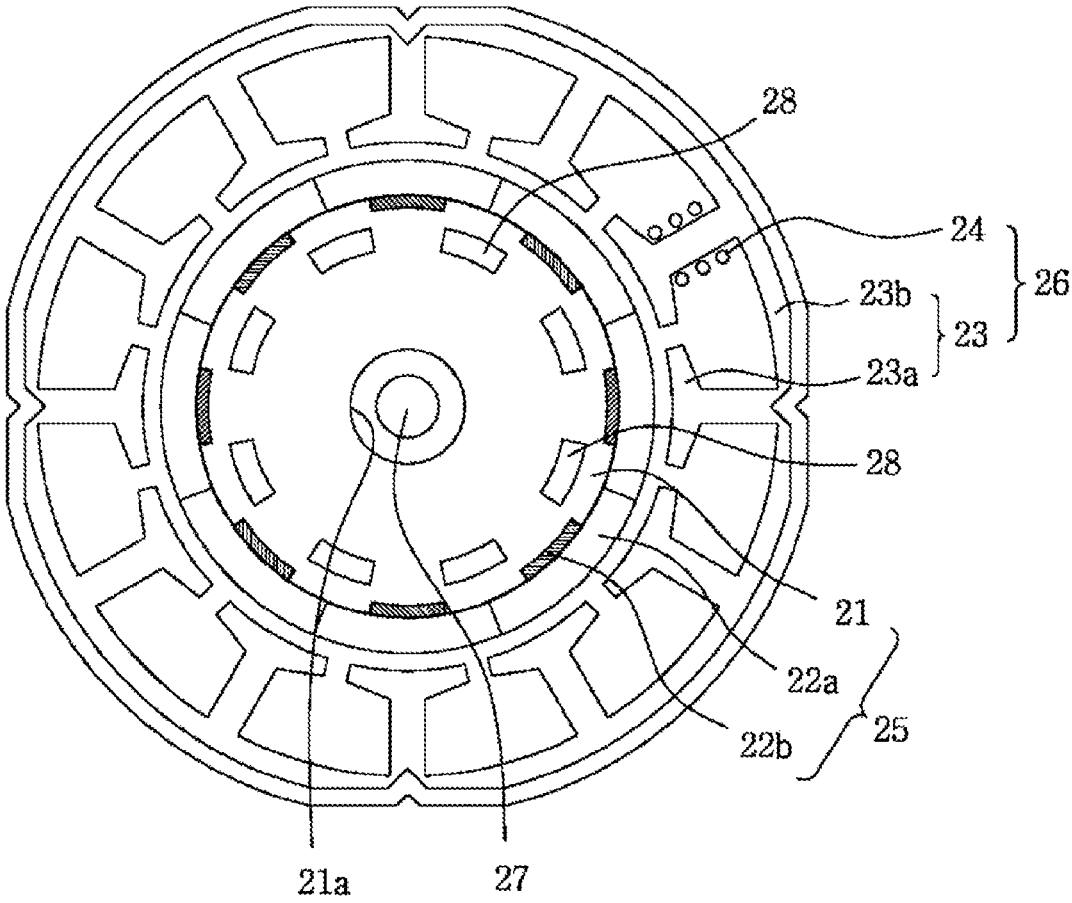
FIG. 2 is a schematic cross-sectional view illustrating an example of an electric motor employed in the waterproof fluid pump of FIG. 1.

Referring to FIGS. 1 and 2, a fluid pump according to an embodiment of the present invention, includes: a support shaft 27 that is fixedly disposed at a center portion of a first case 14; a motor 20 that is rotatably supported to the support shaft 27 and that generates a rotating torque if electric power is applied to the motor; an impeller 43 that is rotatably supported to the support shaft 27 and that pumps fluid; and power transmission units 30 and 40 that transfers the rotating torque of the motor 20 to the impeller 43.

An upper plate 14*d* is formed on top of the first case 14. A throughhole is formed in the upper plate 14*d*, in which the support shaft 27 is fixed through the throughhole. The lower portion of the first case 14 is open.

When the first case 14 is manufactured, the support shaft 27 is integrally formed in the first case 14 by using an insert-molding method. Thus, water or other foreign matters can be fundamentally blocked from being introduced into the inside of the first case 14 through the throughhole of the first case 14 through which the support shaft 27 passes.

The lower portion of the support shaft 27 is positioned in the inside of the first case 14 to thus rotatably support the motor 20, and the upper portion of the support shaft 27 is positioned in the inside of the pump housing 15 that is sealably mounted on top of the first case 14, to thus rotatably support the impeller 43.

A second case 12 whose top portion is clogged to seal the bottom portion of the first case 14, is fixed to the opened bottom of the first case 14, and a third case 11 that seals the inside of the second case 12 is fixed to the opened bottom of the second case 12.

A driver 36 that controls the motor 20 is accommodated in the inside of the second case 12 and a pressing unit 12*a* to which the bottom of the support shaft 27 is pressingly fixed is formed on an upper plate of the second case 12.

A cylindrical protrusion 11*a* is formed in the third case 11 and inserted into the inner surface of the bottom of the second case 12. A sealing O-ring 35*a* is inserted into the protrusion 11*a*. to thus seal between the second case 12 and the third case 11.

At least three bolt fixing units 11*b* and 12*b* are protruded between the third case 11 and the second case 12, in which fixing screws or fixing bolts are combined into fixing holes. At least three bolt fixing units 12*c* and 14*b* are also protruded between the second case 12 and the first case 14, in which fixing screws or fixing bolts are combined into fixing holes.

The motor 20 includes: a stator 26 that is fixed to the inner surface of the first case 14; and a rotor 25 that is disposed with a certain gap from the inner surface of the stator 26, interacts with the stator 26 to then be rotated, and is rotatably supported on the support shaft 27.

The motor 20 is an inner rotor type, in which the rotor 25 is disposed on the inner circumferential surface of the stator 26.

As shown in FIG. 2, the rotor 25 includes: a back yoke 21 that is rotatably supported on the support shaft 27 that passes through a central portion of the back yoke 21; and isotropic magnets 22*a* that are disposed at regular intervals on the outer circumference of the back yoke 21.

In other words, the rotor 25 includes: the back yoke 21 (that is, a rotor core) that is formed of laminated magnetic steel sheets and at a central portion of which a throughhole is formed in which the rotational shaft 27 is coupled through the throughhole; and the ring-shaped isotropic magnets 22*a* that are combined on the outer circumference of the back yoke 21. Divisionally magnetization processed magnets to form N-pole magnets and S-pole magnets alternately are used as the ring-shaped isotropic magnets 22*a*.

It is desirable to integrally form a rotor support 22*d* on the upper and lower surfaces and the outer circumferential surface of the back yoke 21 and isotropic magnets 22*a* of the rotor 25 in an insert molding method by using resin in the rotor 25 in terms of a sealing effect.

The rotor support 22*d* is effective to seal magnets located in the inside of the rotor 25 when a fluid pump is used as a water pump in a humid environment.

In addition, a number of recesses are formed at every predeterminedly set angle on the outer circumferential surface of the back yoke 21 in the rotor 25. Accordingly, it is also possible to insert a number of segment-shaped burial-type anisotropic auxiliary magnets 22*b* into the recesses.

In this case, it is desirable that the burial-type anisotropic auxiliary magnets 22*b* are made of ferromagnetic magnets, for example, a hard ferrite material made of a $SmCo_5$ group, $Sm_2Co_{17}$ group, $Nd_2Fe_{14}B$ group, or $Sm_2Fe_{17}N_3$ group rare-earth alloy. In particular, it is desirable that an Nd-based alloy having a big energy product (BHmax) is, for example, Nd—Fe—B (anisotropic magnet).

Moreover, the ring-shaped isotropic magnets 22*a* that are made of, for example, a ferrite-based material that is available at a low price, are combined on the outer periphery of the back yoke 21.

The burial-type anisotropic auxiliary magnets 22*b* are magnetized in a radial direction of the rotor 25 to thus form an anode. Accordingly, a rotating torque is generated by interaction between a magnetic flux formed by the anisotropic auxiliary magnets 22*b* and a rotating magnetic field formed by electric current flowing in coils 24 of the stator 26.

Meanwhile, a number of leakage preventive holes, i.e., spacers 28 are circularly disposed along an inner side in the circumferential direction of the burial-type anisotropic auxiliary magnets 22*b*, and are formed at regular intervals with a length corresponding to each length of the anisotropic auxiliary magnets 22*b* between the respective two adjacent anisotropic auxiliary magnets 22*b*, The spacers 28 may increase self-resistance to thereby prevent the magnetic flux leakage. As a result, the burial-type anisotropic auxiliary magnets 22*b* form a magnetic circuit from the N-pole to the S-pole in the lateral direction (i.e., the circumferential direction), respectively.

As a result, the rotor 25 of the present invention having the above-mentioned structure has a hybrid magnet structure having an overall 8-pole magnetic pole by a mutual combination of the eight burial-type anisotropic auxiliary magnets 22*b* and the ring-shaped isotropic magnets 22*a* that are magnetized into eight poles. The hybrid magnet structure can entirely maintain a magnetic force not less than those of the anisotropic auxiliary magnets 22*b*, due to the anisotropically oriented burial-type anisotropic auxiliary magnets 22*b*.

An upper bearing 33*b* and a lower bearing 33*a* are mounted on the upper and lower sides of the support shaft 27 that is positioned in the inside of the first case 14, respectively, to thus rotatably support the rotor 25.

Here, since water is not introduced into the first case 14, it is possible to use oil-filled ball bearings having no waterproof functions as the upper bearing 33*b* and the lower bearing 33*a*, to accordingly enhance durability and reduce manufacturing costs when compared with oilless bearings. Of course, it is possible to use oilless bearings as the upper bearing 33*b* and the lower bearing 33*a*.

The stator 26 has a structure that a bobbin is combined with an integral stator core 23 having a number of T-shaped protruding teeth 23*a* on the inner circumference of a cylinder-shaped body 23*b* formed by stacking a number of magnetic steel plates, and a coil 24 is wound on the bobbin.

In addition, the stator 26 may be implemented in an annular form by insert-molding the outer circumference of the stator core 23 using a bulk mould compound (BMC) in order to reinforce a sealing performance after the coil 24 has been wound on the bobbin formed in the outer portion of the stator core 23.

Moreover, the stator 26 may employ an integral type structure that a coil is wound on a number of divided cores to then be integrated by a stator support, other than the integral type stator core 23.

The stator 26 receives a drive signal for the stator coil 24 from a driver 36 that is housed in the second case 12.

An inlet 15*a* through which fluid flows into the inside of the pump housing 15 is formed at the center of the upper portion of the pump housing 15, and an outlet 15*b* through which the pumped fluid is discharged is formed on the side of the pump housing 15. The bottom of the pump housing 15 is formed in an opened state and is sealably fixed on top of the first case 14.

At least three bolt joints 14*c* and 15*d* are protruded for mutual coupling between the pump housing 15 and the first case 14, in which fixing screws or fixing bolts are combined with fastening holes, respectively. In addition, a sealing O-ring 35*b* is inserted between the outer circumferential surface of the first case 14 and the inner circumferential surface of the pump housing 15, to thus seal between the first case 14 and the pump housing 15.

The impeller 43 is placed along a fluid flow passage P that is formed in the inside of the pump housing 15, to thus play a role of pumping fluid flowing in through the inlet 15*a* and discharging the pumped fluid through the outlet 15*b*, and is formed to have a circular plate shaped body 43*a* and a number of wings 43*b* that are radially formed on top of the circular plate shaped body 43*a*.

The impeller 43 is rotatably supported on top of the support shaft 27 and a bearing 34 is disposed between the support shaft 27 and the impeller 43.

In addition, a stopper 44 for preventing the bearing 34 from seceding is coupled on top of the support shaft 27.

It is desirable that an oilless bearing such as a carbon bearing and plastic bearing is used as the bearing 34*b* when considering that the bearing is in contact with fluid.

The power transmission units 30 and 40 includes: a first magnet 30 that is fixed to the rotor 25 and is rotated with the rotor 25: and a second magnet 40 that is disposed facing the first magnet 30 and has an opposite polarity to that of the first magnet 30 to generate an attraction force by interacting with the first magnet 30 and that is fixed to the impeller 43.

It is desirable that the first magnet 30 is fixed on top of the rotor 25 and is formed in a ring shape. In addition, the first magnet 30 may be disposed on the inner circumferential surface of the magnets 22*a* of the rotor 25 and may be disposed to have the same polarities as those of the magnets 22*a* of the rotor 25.

The first magnet 30 is insert-molded together with the magnets 22*a* of the rotor 25 and fixed to the rotor support 22*d*, when the rotor support 22*d* is fabricated. Thus, a separate process is unnecessary to fix the first magnet 30 to the rotor 25, to thereby shorten a manufacturing process.

Here, the first magnet 30 may be implemented into a number of split magnet pieces that are alternately arranged in an N-pole and an S-pole, or a ring-shaped magnet that is divisionally magnetized into an N-pole and an S-pole.

In this case, it is desirable that a number of split magnet pieces or a ring-shaped divisionally magnetized magnet that form the first magnet 30 are disposed to face the divisionally magnetized magnets 22*a*, with respect to mutually same magnetic polarities, respectively.

The second magnet 40 may be mounted in a circumferential direction in the lower surface of the impeller 43 and is formed in a ring shape, and a back yoke 41 may be mounted between the second magnet 40 and the impeller 43 to thus form a magnetic circuit.

The second magnet 40 has an opposite polarity to that of the first magnet 30, and may be implemented into a number of split magnet pieces that are alternately arranged in an N-pole and an S-pole, or a ring-shaped magnet that is divisionally magnetized into an N-pole and an S-pole.

The first magnet 30 and the second magnet 40 are formed as the split magnet pieces or the divisionally magnetized magnets that are disposed to have the opposite magnetic polarities to each other at portions facing each other so that the rotational movement of the first magnet 30 may be transferred to the second magnet 40 to thereby generate an attraction force by the interaction between the first magnet 32 and the second magnet 40.

A function of the waterproof fluid pump that is implemented as mentioned above according to the embodiment of the present invention will follow.

When power is applied to the stator 26 of the motor 20, the rotor 25 is rotated by the interaction between the stator 26 and the rotor 25, and thus the first magnet 30 that is fixed to the rotor 25 is rotated.

Then, the second magnet 40 is rotated together with the first magnet 30 according to an attraction force by the interaction between the first magnet 30 and the second magnet 40 that is disposed facing the first magnet 30.

Accordingly, the impeller 43 to which the second magnet 40 is fixed is rotated around the support shaft 27, to thus pump fluid flowing in through the inlet 15*a* and discharge the pumped fluid through the outlet 15*b*.

As described above, since the impeller 43 that pumps fluid is mechanically separated from the motor 20 that generates a rotating torque that drives the impeller 43 in the fluid pump according to the embodiment of the present invention, fluid such as water can be fundamentally prevented from flowing into the motor 20.

Moreover, in the case of the fluid pump according to the embodiment of the present invention, the motor 20 and the impeller 43 are mutually isolated from each other, and the power transmission units 30 and 40 using the magnetic force between the motor 20 and the impeller 43 are provided. Accordingly, the fluid pump according to the present invention does not need an additional sealing component for sealing the motor 20. In addition, a magnetic gap between the rotor 25 and the stator 26 in the motor 20 is set in an optimal state, to thus enhance efficiency of the motor 20.

In addition, the fluid pump according to the embodiment of the present invention has a waterproof structure that water may not be inherently introduced into the inside of the motor 20. Accordingly, it is possible to support the rotor 25 with a general bearing that does not employ a waterproof structure, to thereby enhance durability together with cost savings.

In the above-described embodiment, it has been described that the driver is accommodated in the inside of the second case. However, it is possible to dispose the driver in the inside of the first case.

In addition, in the above-described embodiment, it has been described that an inner rotor type motor 20 is used in which the stator 26 is disposed at the outer side of the motor 20 and the rotor 25 is disposed at the center of the motor 20 where a magnetic gap is interposed between the stator 26 and the rotor 25, in order to rotatably drive the first magnet 30. However, any type motor that may provide a rotating torque that rotatably drive the first magnet 30, for example, an outer rotor type or double rotor type motor may be used as the motor that is applied in the present invention.

In addition, in the above-described embodiment, it has been described that a core type stator is used as the stator that is applied in the present invention. However, it is possible to use a coreless type stator in the present invention.

Moreover, in the above-described embodiment, it has been described that the back yoke 41 is disposed on the inner side surface of the second magnet 40, in order to form the magnetic circuit. However, it is possible to remove the back yoke 41.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

The fluid pump according to the embodiment of the present invention employs a structure that a motor that generates a rotating torque and an impeller that pumps fluid are isolated from each other, and the rotating torque of the motor is delivered to the impeller by using a magnetic force, thereby fundamentally waterproofing the motor, and thus may be applied to a fluid pump that needs sealing of a motor as in a water pump or fuel pump.

The invention claimed is:

1. A waterproof fluid pump comprising:

a motor that is accommodated in a first case and comprises a stator and a rotor, to thus generate a rotating torque;

an impeller that is accommodated in a pump housing that is mounted in the first case and that receives the rotating torque of the motor to thus pump fluid;

a support shaft to which the rotor and the impeller are rotatably supported and that is fixed to the first case;

a first magnet that is fixed to the rotor and is rotated with the rotor; and a second magnet that is fixed to the impeller and is disposed facing the first magnet and that has opposite polarity to that of the first magnet, wherein the first magnet is disposed on the inner surface of magnets disposed around the rotor and is disposed to match the polarities of the magnets of the rotor.

2. The waterproof fluid pump according to claim 1, wherein the motor is an inner rotor type.

3. The waterproof fluid pump according to claim 1, wherein a second case that accommodates a driver is mounted on an opened bottom portion of the first case and a third case is sealably mounted on an opened bottom portion of the second case.

4. The waterproof fluid pump according to claim 3, wherein a throughhole through which the support shaft passes is formed on a top plate of the first case, in which the support shaft is fixed to the first case in an insert-molding method.

5. The waterproof fluid pump according to claim 3, wherein a pressing unit to which the lower end of the support shaft is pressingly fixed is formed in the second case.

6. The waterproof fluid pump according to claim 1, wherein the rotor comprises:

a back yoke that forms a magnetic circuit and that is rotatably supported to the support shaft;

the magnets that are combined on the outer circumference of the back yoke; and a rotor support that extends from the side ends of the back yoke and the magnets.

7. The waterproof fluid pump according to claim 6, wherein a bearing is disposed between the inner surface of the back yoke and the outer surface of the support shaft in which the bearing is an oil-filled ball bearing.

8. The waterproof fluid pump according to claim 1, wherein the impeller is rotatably supported on the upper end of the support shaft and an oilless bearing is disposed between the impeller and the support shaft.

9. The waterproof fluid pump according to claim 1, wherein the first magnet is fixed on the upper end of the rotor and is formed in a ring shape.

10. The waterproof fluid pump according to claim 6, wherein the first magnet is formed in the rotor support in an insert-molding method together with the magnets of the rotor.

11. The waterproof fluid pump according to claim 1, wherein the second magnet is formed in a ring shape so as to be mounted in a circumferential direction on the bottom surface of the impeller and a back yoke forming a magnetic circuit is provided between the impeller and the second magnet.

* * * * *